US009611712B2

(12) United States Patent
Kalinec

(10) Patent No.: US 9,611,712 B2
(45) Date of Patent: Apr. 4, 2017

(54) LIP SEAL

(75) Inventor: Christopher Lance Kalinec, Houston, TX (US)

(73) Assignee: OneSubsea IP UK Limited, London (GB)

( * ) Notice: Subject to any disclaimer, the term of this patent is extended or adjusted under 35 U.S.C. 154(b) by 261 days.

(21) Appl. No.: 13/370,234

(22) Filed: Feb. 9, 2012

(65) Prior Publication Data

US 2013/0207349 A1 Aug. 15, 2013

(51) Int. Cl.
*E21B 33/035* (2006.01)
*E21B 33/076* (2006.01)
*E21B 33/038* (2006.01)

(52) U.S. Cl.
CPC ..... *E21B 33/035* (2013.01)

(58) Field of Classification Search
CPC .... E21B 33/035; E21B 33/038; E21B 33/043; E21B 33/03; E21B 33/047; E21B 33/085; E21B 34/04; E21B 33/0355; E21B 33/04; E21B 33/06; E21B 33/00; E21B 33/12; E21B 33/1243; F16J 15/025; F16J 15/122; F16J 15/164; F16J 15/027; F16J 15/0881; F16J 15/3204; F16J 15/3228; F16J 15/3232; F16J 15/46
USPC ..... 166/339, 360, 368, 378, 85.3; 277/530, 277/567, 566, 647, 644
See application file for complete search history.

(56) References Cited

U.S. PATENT DOCUMENTS 2,316,713 A * 4/1943 Procter ..... F16J 15/3232 277/553
2,330,425 A * 9/1943 Hilton ..... F16L 17/06 220/230
2,342,458 A * 2/1944 Davies ..... F16J 15/3212 267/161
2,538,198 A * 1/1951 Hosford ..... F16J 15/328 277/437
2,746,781 A * 5/1956 Jones ..... E21B 33/08 15/220.4
2,778,598 A * 1/1957 Bolling, Jr. ..... F16K 3/243 251/333
2,797,944 A * 7/1957 Riesing ..... F16J 15/3248 277/573
2,832,223 A * 4/1958 Andre ..... F16J 15/48 277/634

(Continued)

FOREIGN PATENT DOCUMENTS

EP 0475557 3/1992
EP 2357314 8/2011

(Continued)

OTHER PUBLICATIONS

Cameron; Parallel Bore Radial Lip Metal Seal; http://www.c-a-m.com/Forms/Product.aspx?prodID=b205d15-1cb3-44a . . . ; 2010.

(Continued)

*Primary Examiner* — Matthew R Buck
*Assistant Examiner* — Edwin Toledo-Duran
(74) *Attorney, Agent, or Firm* — Fletcher Yoder, P.C.

(57) ABSTRACT

A system, in certain embodiments, includes a lip seal having an outer diameter portion including an outer protrusion configured to contact a first seal interface, wherein the protrusion has a curved surface.

20 Claims, 3 Drawing Sheets

(56) References Cited

U.S. PATENT DOCUMENTS 2,841,429 A * 7/1958 McCuistion ..... F16J 15/3236 251/900
2,934,363 A * 4/1960 Knox ..... F16J 15/3236 277/436
3,003,799 A * 10/1961 Marchionda ..... F16J 15/3204 277/567
3,013,830 A * 12/1961 Milligan ..... F16J 15/20 277/439
3,058,750 A * 10/1962 Taylor ..... F16J 15/48 277/312
3,061,895 A * 11/1962 Kleinhans ..... E06B 3/62 277/642
3,192,690 A * 7/1965 Taylor ..... F16J 15/48 220/378
3,207,524 A * 9/1965 Trbovich ..... F16J 15/0887 277/647
3,223,426 A * 12/1965 Reid ..... F16J 15/121 277/467
3,279,806 A * 10/1966 Bialkowski ..... F16J 15/48 277/647
3,285,615 A * 11/1966 Trbovich ..... F16J 15/025 277/639
3,342,500 A * 9/1967 Knudson ..... F16J 15/3208 277/530
3,345,078 A * 10/1967 Bialkowski ..... F16J 15/0887 277/647
3,353,831 A * 11/1967 Sweger ..... F16J 15/3268 277/356
3,378,269 A * 4/1968 Castor ..... E21B 33/038 277/336
3,529,837 A * 9/1970 Eaton ..... H01T 13/08 277/592
3,575,432 A * 4/1971 Taylor ..... F16J 15/0893 277/616
3,662,761 A * 5/1972 Hoffman ..... F16K 41/08 137/543.19
3,713,660 A * 1/1973 Luthe ..... F16K 1/42 220/378
3,727,923 A * 4/1973 McEwen ..... F16J 15/008 277/551
3,751,048 A * 8/1973 Rode ..... F16J 15/0887 277/649
3,761,102 A * 9/1973 Nicholson ..... F16J 15/0887 277/647
3,797,836 A * 3/1974 Halling ..... F16L 17/08 277/608
3,857,572 A * 12/1974 Taylor ..... F16J 15/0887 277/609
3,915,462 A * 10/1975 Bruns ..... F16J 15/0887 277/647
4,082,300 A * 4/1978 Harbeck ..... F16J 15/20 277/529
4,121,843 A * 10/1978 Halling ..... F01D 11/005 277/647
4,178,020 A * 12/1979 Dopyera ..... F16L 37/002 277/607
4,199,157 A * 4/1980 Skinner ..... F16L 41/088 277/606
4,336,943 A * 6/1982 Chaplin ..... F01D 11/005 277/643
4,362,323 A * 12/1982 Lodder ..... B29C 57/025 285/110
4,457,523 A * 7/1984 Halling ..... F16J 15/021 277/644
4,477,057 A * 10/1984 Friess ..... F16K 1/2285 251/306
4,602,888 A * 7/1986 Court ..... F16J 15/0887 267/1.5
4,618,154 A * 10/1986 Freudenthal ..... F16J 15/3236 277/530
4,658,847 A * 4/1987 McCrone ..... E06B 5/164 137/72
4,742,874 A * 5/1988 Gullion ..... E21B 33/043 166/115
4,759,555 A * 7/1988 Halling ..... F16J 9/18 277/631
4,813,692 A * 3/1989 Halling ..... F16J 15/021 277/626
4,854,600 A * 8/1989 Halling ..... F16J 15/021 277/626
4,892,632 A * 1/1990 Morris ..... C25B 9/20 204/256
4,903,774 A * 2/1990 Dykes ..... E21B 33/047 166/321
5,002,129 A * 3/1991 Hopper ..... E21B 41/10 166/338
5,031,923 A * 7/1991 Davies ..... F16K 41/026 251/214
5,044,672 A * 9/1991 Skeels ..... E21B 43/013 166/344
5,076,594 A * 12/1991 Baugh ..... F16J 15/002 277/615
5,110,144 A * 5/1992 Burton ..... E21B 33/04 166/115
5,112,066 A * 5/1992 Remmerfelt ..... F16J 15/0887 123/193.4
5,201,835 A * 4/1993 Hosie ..... E21B 33/03 277/314
5,224,715 A * 7/1993 Downes ..... E21B 33/04 277/322
5,246,236 A * 9/1993 Szarka ..... E21B 34/06 277/337
5,249,814 A * 10/1993 Halling ..... F16J 15/0887 228/214
5,325,925 A * 7/1994 Smith ..... E21B 33/04 166/196
5,354,072 A * 10/1994 Nicholson ..... F16J 15/48 277/647
5,509,670 A * 4/1996 Wheeler ..... F16J 15/3272 277/565
5,630,593 A * 5/1997 Swensen ..... F16J 15/0887 277/626
5,669,612 A * 9/1997 Nicholson ..... F16J 15/0887 277/614
5,730,445 A * 3/1998 Swensen ..... F16J 15/0887 277/608
5,769,162 A * 6/1998 Bartlett ..... E21B 34/04 166/321
5,799,954 A * 9/1998 Layer ..... F16J 15/0887 277/614
5,826,378 A * 10/1998 Gallas ..... B60J 10/24 277/644
5,860,680 A * 1/1999 Drijver ..... E21B 19/004 277/564
5,868,204 A * 2/1999 Pritchett ..... E21B 33/043 166/368
5,897,119 A * 4/1999 McMillen ..... F16J 15/3236 277/562
5,984,316 A * 11/1999 Balsells ..... F16J 15/3212 277/553
6,042,121 A * 3/2000 Ma ..... F16J 15/0887 277/608
6,086,069 A * 7/2000 Bedford ..... F16J 15/344 277/358
6,120,037 A * 9/2000 Schmertz ..... F16J 15/0887 277/647
6,161,841 A * 12/2000 Shaw ..... B60K 15/0406 277/642
6,164,663 A * 12/2000 Turner ..... E21B 33/1212 277/602
6,257,594 B1 * 7/2001 Halling ..... F16J 15/0887 277/626
6,296,255 B1 * 10/2001 Hashimoto ..... F16J 15/006 277/558
6,299,178 B1 * 10/2001 Halling ..... F16J 15/0887 277/644
6,302,402 B1 * 10/2001 Rynders ..... F16J 15/0806 277/530

(56) References Cited

U.S. PATENT DOCUMENTS 6,367,551 B1 * 4/2002 Fenton ..... E21B 33/038 166/345
6,367,558 B1 * 4/2002 Borak, Jr. ..... E21B 33/04 166/181
6,634,648 B1 * 10/2003 Rockwell ..... F16C 33/7886 277/560
6,648,333 B2 * 11/2003 Aksit ..... F01D 11/005 277/316
6,840,323 B2 * 1/2005 Fenton ..... B01D 17/0211 166/348
6,932,321 B2 * 8/2005 Baumann ..... F16J 15/025 251/214
6,962,373 B2 * 11/2005 Houghton ..... F16L 21/03 277/626
6,978,839 B2 * 12/2005 Fenton ..... B01D 17/00 166/336
6,983,940 B2 * 1/2006 Halling ..... F16J 15/0887 277/604
6,997,677 B2 * 2/2006 Munshi ..... F01D 11/005 277/642
7,073,796 B2 * 7/2006 Tanioka ..... F16L 15/008 277/616
7,090,224 B2 * 8/2006 Iguchi ..... F01D 11/005 277/603
7,100,925 B2 * 9/2006 Swensen ..... F16J 15/061 277/626
7,121,344 B2 * 10/2006 Fenton ..... E21B 19/002 166/106
7,128,323 B2 * 10/2006 Iguchi ..... F16J 15/0887 277/530
7,171,886 B2 * 2/2007 Herrmann ..... F41A 3/74 277/644
7,195,246 B2 * 3/2007 Aoshiba ..... F16J 15/3236 277/438
7,380,768 B2 * 6/2008 Baumann ..... F16J 15/025 251/214
7,428,912 B2 * 9/2008 Pozzati ..... F16J 15/3212 137/375
7,464,940 B2 * 12/2008 Datta ..... F16J 15/0893 277/555
7,699,110 B2 * 4/2010 Anderson ..... E21B 33/035 166/222
7,699,320 B2 * 4/2010 Iguchi ..... F01D 11/005 277/604
7,789,397 B2 * 9/2010 Halling ..... F16J 15/0887 277/604
7,828,302 B2 * 11/2010 Hurlbert ..... F16J 15/125 277/637
7,837,233 B2 * 11/2010 Johnston ..... F01N 13/1811 285/302
RE42,061 E * 1/2011 Olsson ..... F16C 33/72 277/536
7,938,407 B2 * 5/2011 Datta ..... F16J 15/0887 277/644
8,016,042 B2 * 9/2011 Spiering ..... E21B 33/038 166/338
8,016,297 B2 * 9/2011 Heinemann ..... F01D 11/005 277/644
8,052,152 B2 * 11/2011 Sedlar ..... F16J 15/3224 277/530
8,113,291 B2 * 2/2012 Bailey ..... E21B 33/085 166/379
8,152,172 B2 * 4/2012 Halling ..... F16J 15/022 277/644
8,162,327 B2 * 4/2012 Halling ..... F01D 11/003 277/647
8,230,928 B2 * 7/2012 Cuiper ..... E21B 33/035 138/89
8,240,672 B2 * 8/2012 Grace ..... F16J 15/166 277/353
8,366,113 B2 * 2/2013 Swensen ..... F16J 15/0887 277/312
8,376,057 B2 * 2/2013 Dyson ..... E21B 33/043 166/208
8,393,400 B2 * 3/2013 Buckle ..... E21B 33/04 166/368
8,419,021 B2 * 4/2013 Mellander ..... F16J 15/061 277/567
8,511,691 B2 * 8/2013 Holmes, IV ..... F16L 17/03 277/616
8,567,788 B2 * 10/2013 Bernadat ..... B60T 11/236 277/436
8,622,142 B2 * 1/2014 Shaw ..... E21B 33/04 166/368
2003/0155717 A1 8/2003 Zheng
2007/0034379 A1 * 2/2007 Fenton ..... E21B 19/002 166/368
2007/0138751 A1 * 6/2007 Iguchi ..... F01D 11/005 277/644
2008/0061510 A1 * 3/2008 Li ..... E21B 33/00 166/382
2008/0224422 A1 * 9/2008 Halling ..... F16J 15/022 277/644
2010/0007097 A1 1/2010 Sundararajan
2010/0084143 A1 * 4/2010 Dyson et al. ..... 166/382
2010/0109260 A1 * 5/2010 Mellander ..... F16J 15/061 277/619
2011/0024995 A1 * 2/2011 Schaefer ..... F16J 15/025 277/644
2011/0272892 A1 * 11/2011 Grace ..... F16J 15/166 277/395

FOREIGN PATENT DOCUMENTS

WO 2009066068 5/2009
WO 2011048005 4/2011

OTHER PUBLICATIONS

Cameron; Straight Bore Radial Lip Metal Seal; http://www.c-a-m.com/Forms/Product.aspx?prodID=a9c76ab8-cf1c-464 . . . ; 2010.
International Search Report for PCT/US2012/064724 mailed Dec. 20, 2013.

* cited by examiner

FIG. 5
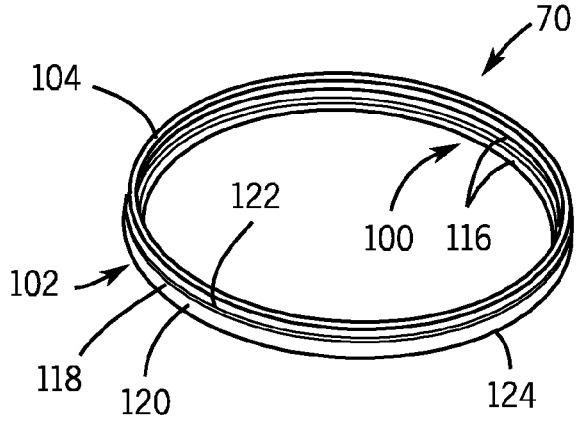
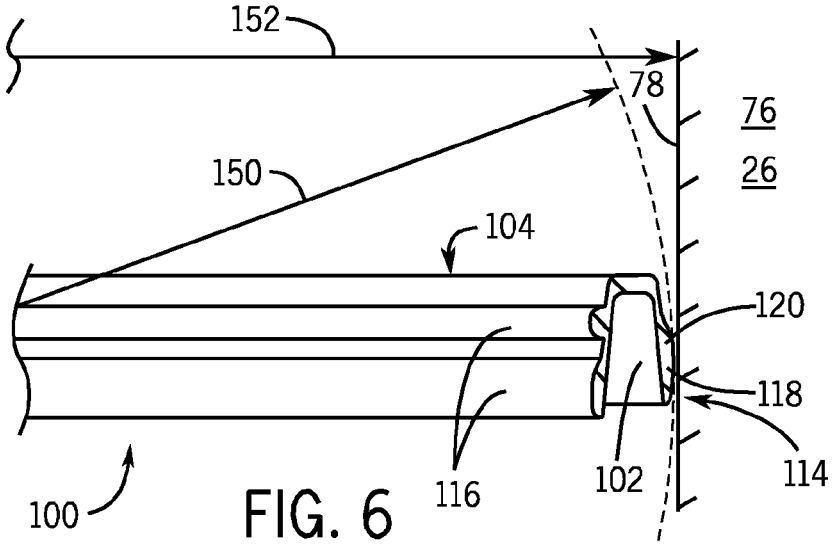
FIG. 6
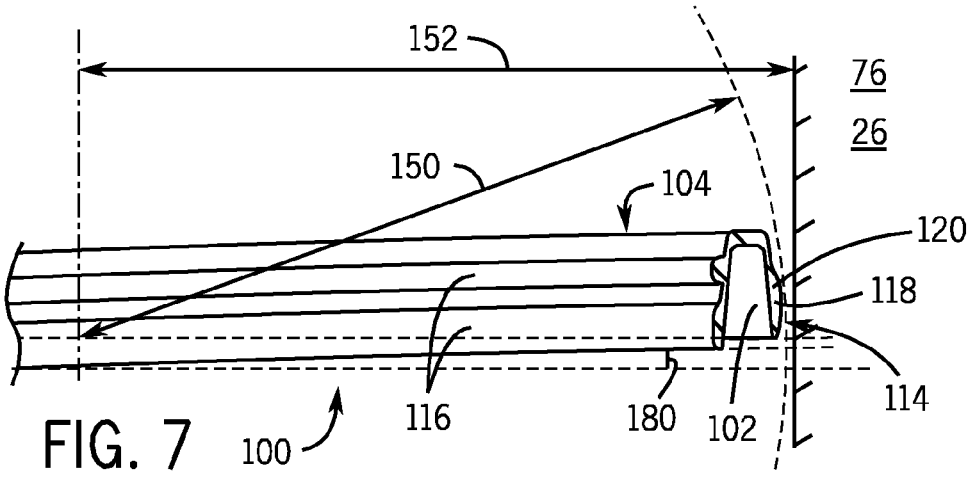
FIG. 7

LIP SEAL

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A variety of subsea equipment, such as mineral extraction equipment, may be subjected both to high pressures and corrosive environments. For example, mineral extraction equipment, such as trees, valves, plugs, and other devices, may experience elevated pressures as fluids flow through the equipment. Such subsea mineral extraction equipment may include seal assemblies to help act as a barrier between the ocean and production fluids flowing through the equipment. Unfortunately, such seal assemblies may have various design shortcomings. For example, subsea seal assemblies can be expensive, difficult to manufacture, and susceptible to performance degradation. Accordingly, a need exists to provide seals in subsea mineral extraction equipment with improved performance and reliability.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 5 is perspective view of a lip seal, in accordance with aspects of the present disclosure;

FIG. 6 is partial cutaway perspective view of a lip seal, in accordance with aspects of the present disclosure; and FIG. 7 is partial cutaway perspective view of a lip seal, in accordance with aspects of the present disclosure.

DETAILED DESCRIPTION OF SPECIFIC EMBODIMENTS

Figure 1:
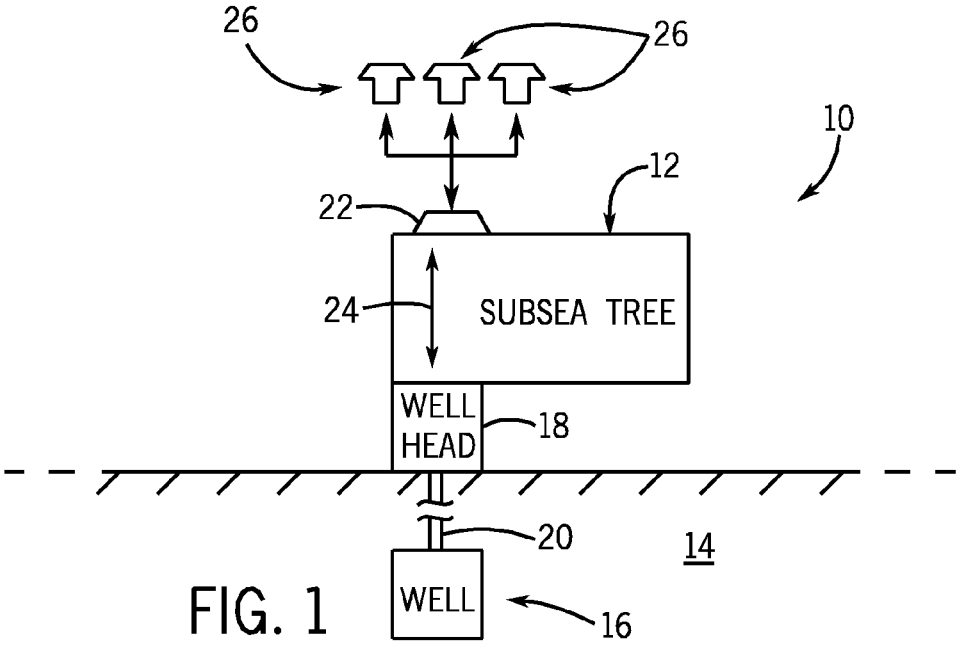
FIG. 1 is a schematic of a subsea mineral extraction system, which may include an improved lip seal, in accordance with aspects of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure include an improved lip seal configured to seal apertures, orifices, or bores in high pressure and corrosive environments. Subsea mineral extraction equipment may include a variety of structures, vessels, pipes, valves and other equipment configured to extract a mineral (e.g., oil or gas) from beneath a subterranean surface. Additionally, subsea mineral extraction equipment may be configured to facilitate a variety of processes associated with mineral extraction, such as drilling, hydraulic fracing, pumping, and so forth. For example, mineral extraction equipment may include a piping and valve structure, such as a tree, configured to flow a variety of fluids, such as a production fluid (e.g., oil or gas), a hydraulic fracing fluid, a chemical fluid, or other fluid. The mineral extraction equipment may further include a variety of valves, plugs, seals, or other components configured to block the flow or leakage of a fluid. For example, the valves, plugs, or seals may be configured to block a fluid from escaping the mineral extraction equipment and entering the surrounding environment (e.g., the surrounding sea water), or vice versa.

As discussed in detail below, the disclosed embodiments provide an improved lip seal (e.g., misalignment tolerant lip seal), which may be used in subsea mineral extraction equipment exposed to high pressure and/or corrosive environments. More specifically, the improved lip seal is configured to allow for misalignment of the lip within a gap, an orifice, or a seal bore formed between two or more components of subsea mineral extraction equipment, while maintaining one or more seal interfaces. For example, the lip seal may include an outer diameter having a spherical or curved sealing surface. As discussed below, the spherical or curved sealing surface may be configured to maintain a seal interface between the outer diameter of the lip seal and a first component of the subsea mineral extraction equipment when a component of the mineral extraction equipment and/or the lip seal is misaligned. Furthermore, the lip seal may include an inner diameter having two inner protrusions configured to contact a second component of the subsea mineral extraction equipment, thereby providing increased stiffness of the inner diameter of the lip seal. In this manner, during potential misalignment of components of the mineral extraction equipment and/or the lip seal, the inner diameter having the two inner protrusions may remain stationary relative to the seal bore, while the outer diameter of the lip seal may move relative to the seal bore. As mentioned above, a seal interface may be maintained between the outer diameter of the lip seal and the first component of the subsea mineral extraction equipment due to the spherical or curved sealing surface of the outer diameter of the lip seal. It is important to note that, while the embodiments disclosed above are described in the context of a subsea tree of a subsea mineral extraction system, the lip seal described may be used in a variety of other applications. For example, the lip seal may be used in subsea BOP stacks, surface mineral extraction systems, sulfur extraction applications, tubing hangers, other mineral extraction systems, or other systems which may include lip seals.

FIG. 1 is a schematic of a subsea mineral extraction system 10 having a subsea tree 12. As mentioned above, the subsea mineral extraction system 10 is used to extract minerals from beneath the surface of a subterranean rock formation 14. For example, the subsea tree 12 may flow a variety of fluids, such as a production fluid (e.g., oil or natural gas), a fracing fluid, a chemical fluid, or other process fluid to or from a well 16 formed in the subterranean rock formation 14. The well 16 may be a natural gas and/or oil well. As shown, the subsea tree 12 is coupled to a wellhead 18 of the well 16. In certain embodiments, the subsea tree 12 may be configured to flow a fracing fluid through the wellhead 18 and into a well bore 20. In other embodiments, the subsea tree 12 may be configured to flow a production fluid extracted from the well 16.

The subsea tree 12 may include a variety of pipes, valves, and other conduits configured to flow a process fluid, such as a production fluid, fracing fluid, chemical fluid, and so forth. For example, in the illustrated embodiment, the subsea tree 12 includes a vertical access connection 22. As a result, a well operator may have separate access to the well 14, while other systems, such as fracing systems, pumping systems, etc. are coupled to the subsea tree 12. As shown, the vertical access connection 22 is generally in line with a vertical axis 24 of the well 14. The vertical access connection 22 may be used to access the well 14 in a variety of circumstances. For example, the vertical access connection 22 may be used for natural gas and/or oil recovery, fracing fluid recovery, insertion of a frac mandrel, and so forth. During other processes, the vertical access connection 22 may not be in use. In such circumstances, the vertical access connection 22 may be plugged or sealed in order to maintain a high pressure in the well 14. More specifically, the vertical access connection 22 may be plugged with one or more of a variety of plugs or tree caps 26. The tree caps 26 may include additional plugs and seals, such as metal or elastomer seals. For example, the tree cap 26 may include a one-way back pressure valve (BPV) plug or a wireline set plug to plug the vertical access connection 22. As will be appreciated, the tree cap 26 may be used in the vertical access connection 22 to isolate the well 16 and the well bore 20. Additionally, the vertical access connection 22 also may be used to insert a variety of tools and other equipment into the well bore 20.

Figure 2:
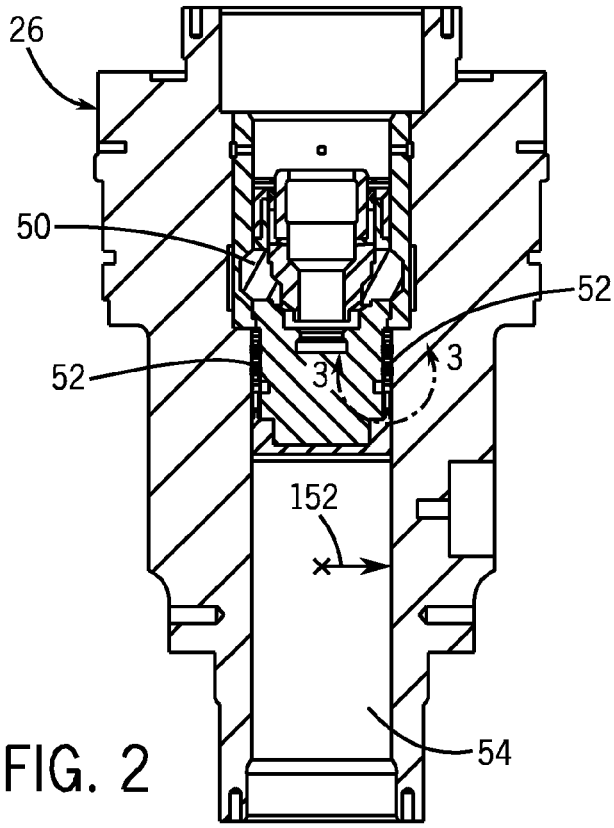
FIG. 2 is a cross-sectional view of a tree cap assembly having a lip seal, in accordance with aspects of the present disclosure.

FIG. 2 is a cross-sectional side view of the tree cap 26, illustrating a plug 50 and seal assemblies 52 (e.g., annular seal assemblies) disposed within the tree cap 26. As discussed above, the tree cap 26 may be disposed within the vertical access connection 22 and may be configured to block the flow of a process fluid flowing within the subsea tree 12. More specifically, the tree cap 26 may block the flow or leakage of a production fluid (e.g., oil or gas), a fracing fluid, a chemical fluid, or other process fluid through the vertical access connection 22 and into the environment (e.g., sea water) surrounding the subsea tree 12 and the subsea mineral extraction system 10.

As shown, the tree cap 26 includes the plug 50 disposed within the tree cap 26. More specifically, the plug 50 is disposed within a bore 54 of the tree cap 26. As mentioned above, in certain embodiments, the plug 50 may be a wireline set plug, a one-way back pressure valve (BPV) plug, or other type of plug. In certain embodiments, the bore 54 of the tree cap 26 may be in communication with the well bore 20. Consequently, the plug 50 within the tree cap 26 may be configured block the flow or leakage of a process fluid through the tree cap 26. Additionally, the plug 50 may support one or more of the seal assemblies 52. As discussed below, the seal assemblies 52 may include a variety of seals (e.g., primary seals, back-up seals, etc.) to further block the flow of a process fluid flowing within the subsea tree 12 to the environment surrounding the subsea tree 12.

Figure 3:
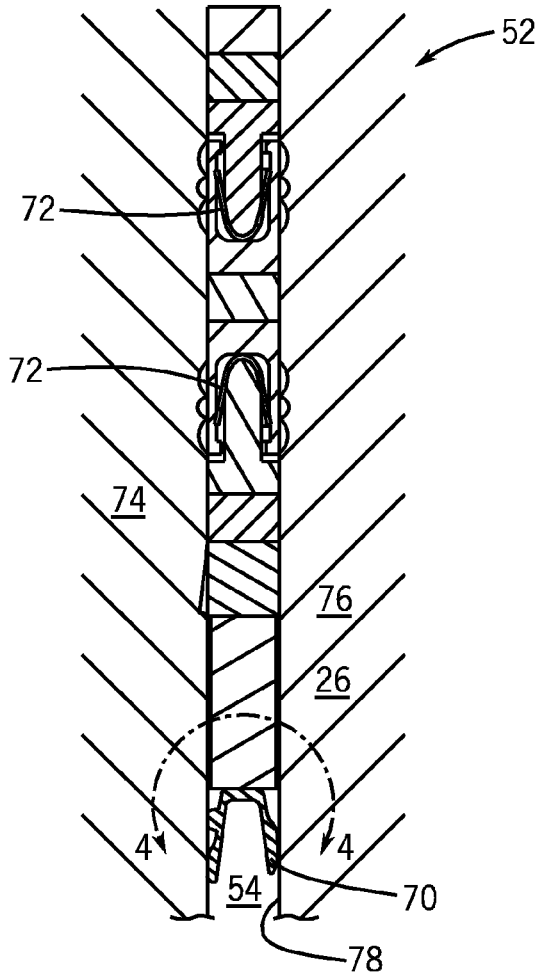
FIG. 3 is a cross-sectional side view of a seal assembly having a lip seal, in accordance with aspects of the present disclosure.

FIG. 3 is a cross-sectional side view, taken within line 3-3 of FIG. 2, of the seal assembly 52, illustrating a lip seal 70 (e.g., a primary seal) and back-up seals 72. As will be appreciated, the seal assembly 52 may be disposed within the bore 54 and between two components (e.g., a first component 74 and a second component 76). For example, the first component 74 may be the plug 50 disposed within the tree cap 26, and the second component may be an interior wall 78 of the tree cap 26. The seal assembly 52 acts as a barrier between the bore 54 of the tree cap 26 and the environment surrounding the subsea tree 12 (e.g., sea water).

In the illustrated embodiment, the lip seal 70, which may be an annular seal disposed about the first component 74 (e.g., the plug 50 or other insert), is a primary seal of the seal assembly 52. For example, the lip seal 70 may be directly exposed to a process fluid within the bore 54. That is, the lip seal 70 may be may be configured to contact and block a process fluid flowing within the bore 54 of the tree cap 26. In certain embodiments, the lip seal 70 may be formed from a metal configured to withstand elevated pressures and/or corrosive environments (e.g., a subsea environment). For example, the lip seal 70 may be formed from titanium or a nickel alloy, such as Inconel. Additionally, the lip seal 70 may be formed using a machining process, such as electrical discharge machining. As discussed in detail below, the lip seal 70 is configured to maintain one or more seal interfaces between the first and second components 74 and 76, even during misalignment of the first component 74 and/or the lip seal 70. In other words, the lip seal 70 may be described as misalignment tolerant, alignment independent, or generally self-adjusting to maintain a seal regardless of any alignment or misalignment. As mentioned above, the seal assembly 52 further includes the back-up seals 72, which may also block the flow or leakage of a process fluid from the bore 54 of the tree cap 26 into the surrounding environment. In certain embodiments, the back-up seals 72 may be formed from an elastomer or plastic.

Figure 4:
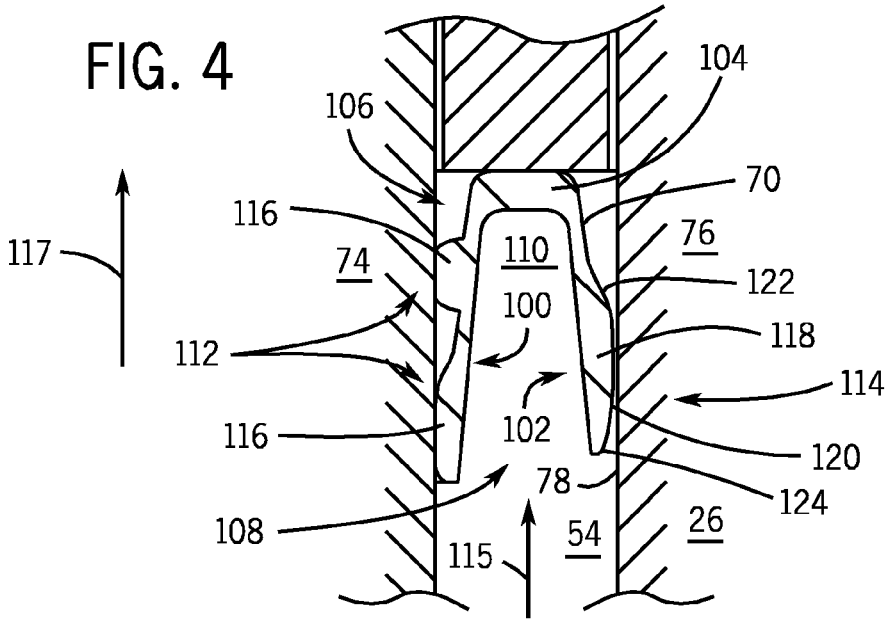
FIG. 4 is a cross-sectional side view of a portion of the seal assembly of FIG. 3, taken within line 4-4, illustrating a lip seal disposed within a well bore of a tree cap assembly, in accordance with aspects of the present disclosure.

FIG. 4 is a cross-sectional side view of the lip seal 70, taken within line 4-4 of FIG. 3, illustrating an inner diameter portion 100 (e.g., inner annular leg) and an outer diameter portion 102 (e.g., outer annular leg) of the lip seal 70. As shown, the inner diameter portion 100 of the lip seal 70 and the outer diameter portion 102 of the lip seal 70 are joined by a top portion 104 (e.g., intermediate annular portion). More specifically, the inner diameter portion 100, the outer diameter portion 102, and the top portion 104 are joined such that a cross-section 106 of the lip seal 70 is generally arcuate, or U-shaped, to form a U-shaped ring. In this manner, the lip seal 70 forms an opening 108 (e.g., annular opening), which exposes the bore 54 of the tree cap 26 to a cavity 110 generally defined by the inner diameter portion 100, the outer diameter portion 102, and the top portion 104 of the lip seal 70.

In the illustrated embodiment, the inner diameter portion 100 of the lip seal 70 forms a seal interface 112 (e.g., annular seal interface) with the first component 74 (e.g., the plug 50 or other insert). For example, the seal interface 112 may function by virtue of geometric interference. That is, in a free state of the lip seal 70, a diameter of the lip seal 70 at the inner diameter portion 100 may be smaller than an outer diameter of the first component 74 (e.g., the plug 50 or other insert). Similarly, the outer diameter portion 102 of the lip seal 70 forms a seal interface 114 (e.g., annular seal interface) with the second component 76 (e.g., the interior wall 78 of the tree cap 26). As similarly discussed above, the seal interface 114 may also function by virtue of geometric interference. That is, in a free state of the lip seal 70, a diameter of the lip seal 70 at the outer diameter portion 102 may be larger than an inner diameter of the second component 76 (e.g., the interior wall 78 of the tree cap 26).

With the cavity 110 exposed to the bore 54, a flow and/or pressure from a process fluid within the bore 54, indicated by arrow 115, may be harnessed and built up within the cavity 110. As a result, the seal interfaces 112 and 114 may be increased, strengthened, or improved. That is, the pressure and/or flow of the process fluid within the bore 54 may increase, strengthen, or improve the seal interface 112 between the inner diameter portion 100 and the first component 74 (e.g., the plug 50 or other insert), and the pressure and/or flow of the process fluid within the bore 54 may increase, strengthen, or improve the seal interface 114 between the outer diameter portion 102 and the second component 76 (e.g., the interior wall 78 of the tree cap 26). For example, the pressure and/or flow of the process fluid within the bore 54 may create an outwardly biasing force, which biases the inner diameter portion 100 (e.g., inner annular leg) and the outer diameter portion 102 (e.g., outer annular leg) of the lip seal 70 away from one another toward the respective first and second components 74 and 76. Thus, the pressure and/or flow of the process fluid within the bore 54 further energizes the lip seal 70 to increase the effectiveness of the seal with the first and second components 74 and 76.

As shown, the inner diameter portion 100 includes two inner protrusions 116 (e.g., annular protrusions), which may be curved protrusions, that contact the first component 74 to form the seal interface 112. In other words, the two inner protrusions 116 of the inner diameter portion 100 contact the first component 74 to create two separate contact interfaces (e.g., seal points or regions) of the seal interface 112. In this manner, the seal interface 112 may have two seal barriers (e.g., annular seal barriers), which may block flow or leakage of a process fluid between the inner diameter portion 100 of the lip seal 70 and the first component 74. In the illustrated embodiment, the two inner protrusions 116 are arranged vertically, in an axial 117 direction. The two inner protrusions 116 (e.g., annular protrusions) contacting the first component 74 may also serve to provide added stiffness to the lip seal 70 (e.g., the inner diameter portion 100 of the lip seal 70) during misalignment of the lip seal 70 and/or the first component 74 (e.g., the plug 50). For example, the two inner protrusions 116 may also be described as structural ribs, stiffness enhancing ribs, or the like. If any misalignment occurs between the lip seal 70 and the first component 74 (e.g., the plug 50 or other insert), then the two inner protrusions 116 of the inner diameter may block the inner diameter portion 100 from moving or pivoting. Instead, If any misalignment occurs between the lip seal 70 and the first component 74 (e.g., the plug 50 or other insert), then the outer diameter portion 102 may be configured to move or flex, while still maintaining the seal interface 114 between the outer diameter portion 102 and the second component 76 (e.g., the interior wall 78 of the tree cap 26). Although the depicted embodiment includes the two protrusions 116 on the inner diameter portion 100 and the one protrusion 118 on the outer diameter portion 102, other embodiments may reverse this configuration to provide the two protrusions 116 on the outer diameter portion 102 and the one protrusion 118 on the inner diameter portion 100. Thus, the lip seal 70 may be configured to provide stiffness on either one of the portions 100 or 102, while providing flexibility, freedom of movement, and/or pivotability on the other one of the portions 100 or 102.

In certain embodiments, the portions 100 and 102 may substantially differ in their degree of stiffness, contact surface area, or other characteristics, such that one of the portions 100 or 102 is able to more freely move or flex relative to the other portion. For example, in the illustrated embodiment, the portion 100 is stiffer and less likely to move than the portion 102, while in other embodiments the portion 102 may be stiffer and less likely to move than the portion 100. In either case, the stiffness ratio (or flexibility ratio) may range between approximately 1.1:1 to 25:1, 1.5:1 to 20:1, 2:1 to 15:1, 3:1 to 10:1, or 4:1 to 6:1. Furthermore, the contact surface area ratio (e.g., protrusions 116 versus protrusion 118) may range between approximately 1.1:1 to 25:1, 1.5:1 to 20:1, 2:1 to 15:1, 3:1 to 10:1, or 4:1 to 6:1. However, in some embodiments, the portion 100 may simply have a greater number of protrusions than the portion 102, thereby improving the bite, hold, or gripping action of the portion 100 relative to the portion 102. For example, the ratio of protrusions of the portion 100 versus the portion 102 may greater than or equal to approximately 2:1, 3:1, 4:1, 5:1, 6:1, 7:1, 8:1, 9:1, or 10:1. Again, a variety of differences may exist between the portion 100 and the portion 102, such that the portion 102 is able to flex or move relative to the portion 100, while also pivoting along the surface 78 to maintain a consistent seal.

The outer diameter portion 102 of the lip seal 70 includes an outer protrusion 118 (e.g., annular protrusion) having a curved surface 120. Specifically, the curved surface 120 of the outer protrusion 118 has a radius of curvature from an axial top 122 of the outer protrusion 118 to an axial bottom 124 of the outer protrusion 118. For example, the radius of curvature of the curved surface 120 may proportional to, equal to, or approximately equal to (e.g., +/−1, 2, 3, 4, 5, 6, 7, 8, 9, or 10 percent), a radius of the bore 54 of the tree cap 26. Similarly, the radius of curvature of the curved surface 120 may be proportional to, equal to, or approximately equal to (e.g., +/−1, 2, 3, 4, 5, 6, 7, 8, 9, or 10 percent), an outer radius of the lip seal 70. As discussed above, the lip seal 70 may be configured to maintain seal interfaces (e.g., the seal interfaces 112 and 114) between the first component 74 and the second component 76 during misalignment of the first component 74 and/or the lip seal 70, thereby increasing the reliability of the lip seal 70. For example, the outer diameter portion 102 of the lip seal 70 may be configured to flex, while maintaining the seal interface 114 between the outer protrusion 118 and the second component 76 (e.g., the inner wall 78 of the tree cap 26). During misalignment of the first component 74 (e.g., the plug 50 or other insert) and/or the lip seal 70, the two inner protrusions 116 of the inner diameter portion 100 may enable the inner diameter portion 100 of the lip seal 70 to remain relatively fixed or stiff, while the outer diameter portion 102 may flex or move relative to the second component 76 and the bore 54. As will be appreciated, the inner diameter portion 100, which has the seal interface 112 having two contact points (e.g., the two inner protrusions 116) may be more stiff or fixed than the outer diameter portion 102, which has the seal interface 114 having one contact point (e.g., the outer protrusion 118), during misalignment of the lip seal 70 and/or the first component 74 (e.g., the plug 50 or other insert). Furthermore, the curved surface 120 of the outer protrusion 118 of the outer diameter portion 102 may enable the outer protrusion 118 to maintain the seal interface 114 between the outer diameter portion 102 and the second component 76 (e.g., the inner wall 78 of the tree cap 26). For example, the curved surface 120 of the outer protrusion 118 may function as a pivot point, which enables the outer protrusion 118 to pivot (while remaining sealed) along the inner wall 78 during flexing or movement of the outer diameter portion 102. In this manner, the lip seal 70 may accommodate misalignment of the lip seal 70 and/or the first component 74 (e.g., the plug 50 or other insert). Additionally, the ability of the lip seal 70 to accommodate misalignment of the first component 74 (e.g., the plug 50 or other insert) and/or the lip seal 70 may reduce the need for tight or close manufacturing and mating tolerances the lip seal 70, thereby decreasing the manufacturing costs and/or increasing the reliability of the lip seal 70. Again, in other embodiments, the protrusions 116 and 118 on the inner and outer diameter portions 100 and 102 may be reversed for a particular application, such that the outer diameter portion 102 has the two protrusions 116 (e.g., e.g., for stiffness and improved sealing), while the inner diameter portion 100 has the protrusion 118 for increased flexibility, movement, and pivoting.

FIGS. 5-7 are perspective views of the lip seal 70, illustrating the curved surface 120 of the outer protrusion 118 of the outer diameter portion 102 of the lip seal 70. The illustrated embodiment of the lip seal 70 has an annular configuration, as similarly mentioned above. As a result, in certain embodiments, the lip seal 70 may be disposed about the first component 74 (e.g., the plug 50 or other insert), and between the first component 74 and the second component 76 (e.g., the inner wall 78 of the tree cap 26).

FIG. 6 is a partial perspective view of the lip seal 70, illustrating the cross-section 106 of the lip seal 70 and the curved surface 120 of the protrusion 118 of the outer diameter portion 102 of the lip seal 70. In the illustrated embodiment, the lip seal 70 is in a relatively aligned, or level, position, relative to the second component 76 (e.g., the interior wall 78 of the tree cap 26). As described above, the curved surface 120 may have a radius of curvature 150 proportional to, equal to, or approximately equal to (e.g., +/−1, 2, 3, 4, 5, 6, 7, 8, 9, or 10 percent), a radius 152 of the bore 54 of the tree cap 26. Similarly, the radius of curvature 150 may be proportional to, equal to, or approximately equal to (e.g., +/−1, 2, 3, 4, 5, 6, 7, 8, 9, or 10 percent), an outer radius of the lip seal 70. In this manner, the seal interface 114 between the outer diameter portion 102 of the lip seal 70 and the second component 76 (e.g., the interior wall 78 of the tree cap 26) may be maintained during misalignment of the lip seal 70 and/or the first component 74 (e.g., the plug 50 or other insert). That is, the outer diameter portion 102 may move or flex relative to the inner diameter portion 100 and the second component 76 (e.g., the interior wall 78 of the tree cap 26), such that the seal interface 114 between the curved surface 120 of the protrusion 118 of the outer diameter portion 102 and the second component 74 (e.g., the interior wall 78 of the tree cap 26) may be maintained.

FIG. 7 is a partial perspective view of the lip seal 70, illustrating the cross-section 106 of the lip seal 70 and the curved surface 120 of the protrusion 118 of the outer diameter portion 102 of the lip seal 70. In the illustrated embodiment, the lip seal 70 is generally misaligned relative to the second component 76 (e.g., the interior wall 78 of the tree cap 26). More specifically, the lip seal 70 is misaligned, or tilted, at an angle 180 relative to the second component 76 (e.g., the interior wall 78 of the tree cap 26). As described above, the radius of curvature 150 of the curved surface 120 may be proportional to, equal to, or approximately equal to (e.g., +/−1, 2, 3, 4, 5, 6, 7, 8, 9, or 10 percent), the radius 152 of the bore 54 of the tree cap 26. In other embodiments, the radius of curvature 150 of the curved surface 120 may be approximately 10 to 500, 20 to 400, 30 to 300, 40 to 200, 50 to 150, 60 to 140, 70 to 130, 80 to 120, or 90 to 110 percent of the radius 152 of the bore 54 of the tree cap 26. Regardless of the precise curvature of the surface 120, the seal interface 114 between the outer diameter portion 102 of the lip seal 70 and the second component 76 (e.g., the interior wall 78 of the tree cap 26) may be maintained during misalignment of the lip seal 70 and/or the first component 74. In other words, the outer diameter portion 102 may move or flex relative to the second component 76 (e.g., the interior wall 78 of the tree cap 26). As a result, the seal interface 114 between the curved surface 120 of the protrusion 118 of the outer diameter portion 102 and the second component 76 (e.g., the interior wall 78 of the tree cap 26) may be maintained and may block flow or leakage of a process fluid from the bore 54 of the tree cap 26 to the environment surrounding the subsea tree 12 (e.g., sea water). In this manner, the close or tight manufacturing and/or mating tolerances of the lip seal 70 may be reduced, thereby decreasing the manufacturing cost and increasing the reliability of the lip seal 70.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an underwater component; and an annular lip seal disposed within a bore of the underwater component, wherein the annular lip seal comprises:

a first annular portion having a first seal interface, wherein the first seal interface comprises a first protrusion having a curved surface configured to pivot and/or move along a first sealing surface to maintain a seal during misalignment of the annular lip seal, wherein the first protrusion is the only protrusion of the first annular portion configured to contact the first seal interface;

a second annular portion having a second seal interface, wherein the second seal interface comprises at least two second protrusions configured to engage a second sealing surface, wherein each of the at least two second protrusions has an arcuate surface; and an intermediate annular portion connecting first ends of the first and second annular portions about an annular space, wherein second ends of the first and second annular portions are free to move toward and away from one another, wherein a first contact point of the first protrusion along the first sealing interface is positioned axially between respective second contact points of the at least two second protrusions with the second sealing interface.

2. The system of claim 1, wherein the curved surface has a radius of curvature within approximately plus or minus 10 percent of a radius of the bore of the underwater component.

3. The system of claim 1, wherein the first annular portion is an inner annular portion and the second annular portion is an outer annular portion.

4. The system of claim 1, wherein the first annular portion is an outer annular portion and the second annular portion is an inner annular portion.

5. The system of claim 1, wherein the underwater component comprises a subsea tree.

6. The system of claim 5, wherein the underwater component comprises a tree cap, a removable plug, or a combination thereof.

7. The system of claim 1, wherein the curved surface extends at least half an axial length of the first annular portion.

8. The system of claim 1, wherein the annular lip seal is formed from titanium or a nickel alloy.

9. The system of claim 1, wherein the annular space is configured to receive a process fluid flowing through the underwater component to bias the first and second annular portions away from one another.

10. The system of claim 1, comprising a seal assembly having the annular lip seal, wherein the seal assembly comprises one or more back-up seals, and the seal assembly is configured to be disposed between a tree cap and a plug.

11. A system, comprising:

a subsea mineral extraction system, comprising:

a metal lip seal, comprising:

an outer diameter portion comprising an outer protrusion configured to contact a subsea component, wherein the outer protrusion has a curved surface that curves from an axial top of the outer protrusion to an axial bottom of the outer protrusion, wherein the curved surface has a radius of curvature that curves from the axial top of the outer protrusion to the axial bottom of the outer protrusion, wherein the radius of curvature is within approximately plus or minus 10 percent of a radius of a bore configured to support the metal lip seal; and an inner diameter portion coupled to the outer diameter portion by a top portion, wherein the inner diameter portion, the outer diameter portion, and the top portion form a cavity.

12. The system of claim 11, wherein the metal lip seal is formed from titanium or a nickel alloy.

13. The system of claim 11, wherein the inner diameter portion comprises at least two inner protrusions arranged vertically in an axial direction.

14. The system of claim 11, wherein the cavity is configured to be exposed to a process fluid within the subsea mineral extraction system.

15. The system of claim 11, wherein the metal lip seal has an annular configuration, and wherein the outer protrusion is the only protrusion of the outer diameter portion.

16. The system of claim 11, wherein subsea mineral extraction system comprises a seal assembly having the metal lip seal, and the seal assembly is configured to be disposed between an inner wall of a tree cap and a plug disposed within the tree cap.

17. The system of claim 11, wherein the radius of curvature is approximately equal to the radius of the bore configured to support the metal lip seal.

18. A system comprising:

a lip seal, comprising:

an inner diameter portion first and second inner protrusions extending toward a central axis of the lip seal to respective first and second radii, wherein an intermediate portion with a third radius is disposed between the first and second protrusions, wherein the first and second radii are less than the third radius, wherein the first and second inner protrusions are configured to contact a first component;

an outer diameter portion comprising only one outer protrusion extending away from the central axis of the lip seal, wherein the outer protrusion is configured to contact a second component, wherein the outer protrusion has a curved surface extending from an axial top of the outer protrusion to an axial bottom of the outer protrusion, and wherein the curved surface extends at least half an axial length of the outer diameter portion, and the axial length extends from a first axial end surface to a second axial end surface of the outer diameter portion; and a top portion coupling the inner diameter portion and the outer diameter portion, wherein the inner diameter portion, the outer diameter portion, and the top portion form a cavity configured to be exposed to a fluid flowing between the first component and the second component, and wherein the lip seal is formed from titanium, a nickel alloy, or other metal.

19. The system of claim 18, comprising a subsea mineral extraction system configured to support the lip seal, wherein the lip seal is configured to block the flow or leakage of a production fluid.

20. The system of claim 18, wherein the lip seal is configured to be mounted in a subsea mineral extraction system to block the flow or leakage of a production fluid of the subsea mineral extraction system between the first component and the second component.

* * * * *